US006332422B1

(12) United States Patent
Laroche

(10) Patent No.: US 6,332,422 B1
(45) Date of Patent: Dec. 25, 2001

(54) HULL MODIFICATION TO MINIMIZE PORPOISING OF A BOAT

(75) Inventor: Fernand Laroche, Granby (CA)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/607,951

(22) Filed: Jun. 30, 2000

(51) Int. Cl.[7] ..... B63B 1/18
(52) U.S. Cl. ..... 114/271; 114/291
(58) Field of Search ..... 114/271, 291

(56) References Cited

U.S. PATENT DOCUMENTS 4,398,483 * 8/1983 Wood et al. ..... 114/271
4,790,783 * 12/1988 Karls ..... 440/66
4,903,626 * 2/1990 Haines ..... 114/291

* cited by examiner

*Primary Examiner*—Sherman Basinger
(74) *Attorney, Agent, or Firm*—Pillsbury Winthrop LLP

(57) ABSTRACT

A hull is described having bow, stern, port and starboard sides. At least one chine extends longitudinally from a first point near the bow to a second point near the stern of the hull. At least one wedge section is disposed along the at least one chine and is adapted to minimize porpoising of the hull when in operation. A boat having such a hull is also described.

24 Claims, 2 Drawing Sheets

HULL MODIFICATION TO MINIMIZE PORPOISING OF A BOAT

FIELD OF THE INVENTION

The present invention relates to the construction of a boat hull. More specifically, the present invention concerns a modification to a boat hull to minimize porpoising of the boat when underway.

BACKGROUND OF THE INVENTION

In the prior art, boats are known with a wide variety of hull configurations. While the exact shape of the hull often differs from one boat to the next, most boat hulls may be characterized as having a V-shape (in lateral cross-section). In addition, most hulls are adorned with raised or recessed ridges that extend longitudinally along the hull. These ridges are referred to in the art as "chines." Some boat hulls may also incorporate laterally extending ridges or recesses, which are also referred to as chines.

Regardless of their placement and orientation, chines are included on a boat's hull to improve its performance and stability during operation. For example, chines are useful to control lateral motion of the vessel when underway.

Lateral motion, however, is not the only type of motion experienced by boats, especially speed boats. Speed boats operate across a wide range of different speeds. Accordingly, it is possible that a hull that operates acceptably at low speed may not operate acceptably at higher speeds.

One type of motion that may become pronounced at higher speeds is a phenomenon known as "porpoising," which means that the boat tends to rhythmically move up and down while travelling forward. ("Porpoising" refers to the motion of the boat that is like the movement of a porpoise jumping out of the water.)

Porpoising occurs when the center of gravity and the center of buoyancy of the boat are close together but are not in equilibrium with one another.

In most cases, porpoising is more likely to occur when the boat is at a higher speed than when the boat is at a lower speed. At lower speeds, a majority of the hull of the boat is in contact with the water, so the boat is in a condition where the equilibrium between the center of buoyancy and the center of gravity of the boat is not in question. However, as the boat's speed increases, the hull generates greater lift (which is a function of the boat's speed). This means that, at higher speeds, less of the boat's hull contacts the water as the bow of the boat rises out of the water. As a result, equilibrium between the center of gravity and center of buoyancy may not be established, resulting in porpoising of the boat when underway.

SUMMARY OF THE INVENTION

It is, therefore, an object of the present invention to provide a modification to a boat hull that helps to minimize porpoising of a vessel when underway.

It is a further object of the present invention to provide a modification to the chines on the hull of a boat to minimize the porpoising of a boat.

It is still a further object of the present invention to provide a hull with bow, stern, port and starboard sides. At least one chine extends longitudinally from a first point near the bow to a second point near the stern. At least one wedge section is disposed along the at least one chine where the at least one wedge is adapted to minimize porpoising of the hull when in operation.

It is still another object of the present invention to provide a hull that includes two chines, one disposed on the port side and the other disposed on the starboard side, where each chine is V-shaped in cross-section. In addition, each chine has an inner side facing a centerline of the hull and has an outer side facing a side of the hull. Furthermore, two wedge sections are provided, each one disposed at the second point on the two chines.

Another object of the present invention is to provide a hull where the two wedge sections are triangular, are disposed on the inner sides of the chines, and face inwardly toward the centerline of the hull.

It is still another object of the present invention to provide a hull with chine end sections disposed at the second point of each chine, forming a triangular end to each chine, where the wedge sections are disposed adjacent to the chine end sections.

A further object of the present invention is to provide a hull where the wedge sections and chine end sections share a common edge.

Additionally, it is an object of the present invention to provide a hull where the wedge sections are disposed longitudinally about 1800 mm from a forward-most portion of the bow.

Further, it is an object of the present invention to provide a hull where the wedge sections are disposed laterally about 230 mm from the centerline of the hull.

It is still another object of the present invention to provide a hull where the wedge sections have a length of 150 mm along a first edge, 160 mm along a second edge, and a predetermined length along a third edge.

Another object of the present invention is to provide a hull where the chine end sections are triangular in shape with a length of 115 mm along a first edge, 100 mm along a second edge, and, along a third edge, are equal in length to the third edge of the wedge sections.

A further object of the present invention is to provide a boat with at least one wedge section disposed on at least one chine of a hull having the characteristics detailed above.

BRIEF DESCRIPTION OF THE DRAWINGS

The various embodiments of the present invention are illustrated throughout the figures, in which.

DETAILED DESCRIPTION OF THE PREFERRED EMBODIMENTS

Figure 2:
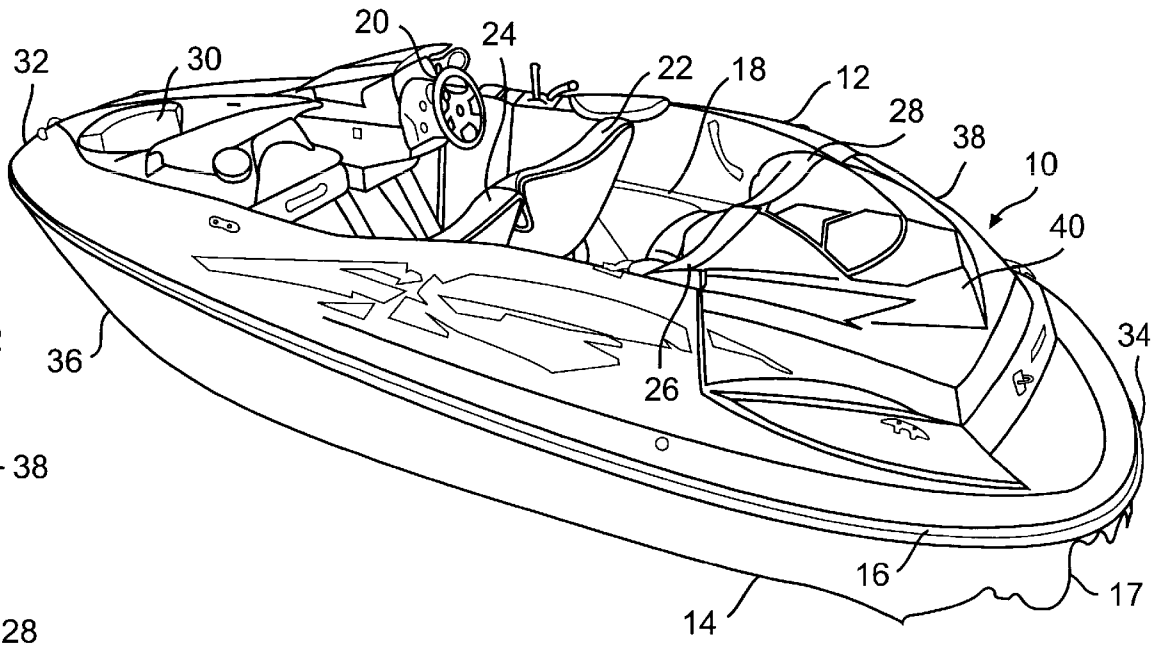
FIG. 2 is a perspective side view of the boat illustrated in FIG. 1.
Figure 1:
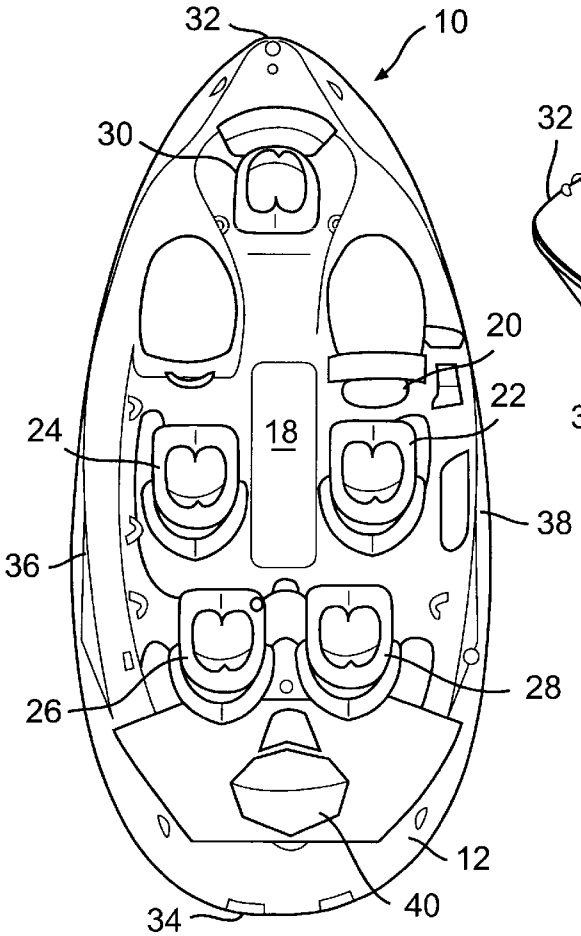
FIG. 1 is a top view of a boat onto the hull of which are included the modifications of the present invention.
Figure 3:
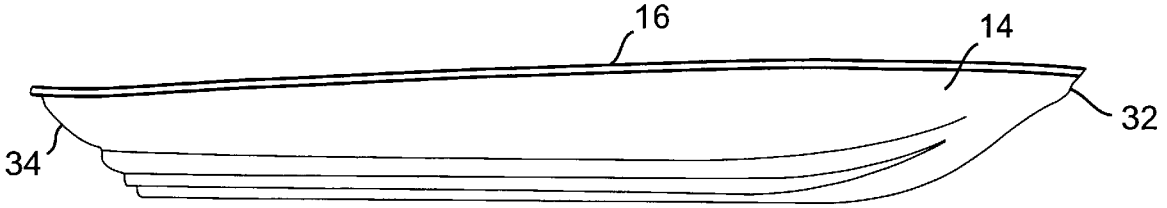
FIG. 3 is a side view of the hull of the boat illustrated in FIG. 1.

FIGS. 1 and 2 generally illustrate a boat 10 constructed according to the teachings of the present invention. It should be understood, however, that boat 10 may be constructed to accommodate any number of deck configurations while remaining within the scope of the present invention.

The preferred embodiment of boat 10 includes a deck 12, which is defined as the portion of boat 10 above hull 14.

Deck 12 and hull 14 are joined along a seam 16 in a manner known to those skilled in the art. Preferably, deck 12 and hull 14 are joined by an adhesive that prevents the ingress of water into the interior of boat 10.

Boat 10 is preferably provided with a jet propulsion system (not illustrated) that is powered by an internal combustion engine. The jet propulsion system draws water from underneath boat 10 through an inlet (not shown). For reference, the location of the engine 11 is generally designated in FIG. 4. Water is drawn through the inlet and is accelerated by an impeller in a tunnel incorporated within the bottom of hull 14. The impeller accelerates the water and discharges the water, at a greatly increased speed, through a nozzle 17 at the rear (or stern) of boat 10. The discharge of water from nozzle 17 provides the motive force for boat 10.

While it is preferred that boat 10 be jet propelled, it will be readily recognized by those skilled in the art that any suitable propulsion system may be substituted therefor without deviating from the scope and spirit of the present invention. For example, boat 10 may be equipped with a traditional propeller to provide a motive force.

In the preferred embodiment of boat 10, deck 12 includes a passenger area 18. A steering device 20, such as a steering wheel, is provided in passenger area 18. Deck 12 incorporates at least five seats, a captain's seat 22, positioned behind steering device 20, and four passenger seats 24, 26, 28, and 30. Seat 30 is a rearwardly-facing seat, while seats 20, 22, 24, and 26 are all forwardly-facing. Boat 10 (and, consequently, deck 12 and hull 14) defines a bow 32, a stern 34, a port side 36, and a starboard side 38. Generally, the location of the engine 11 for boat 10 is at the stern 34, beneath a rear access door (or trunk) 40. Trunk 40 provides maintenance access to the engine.

Figure 4:
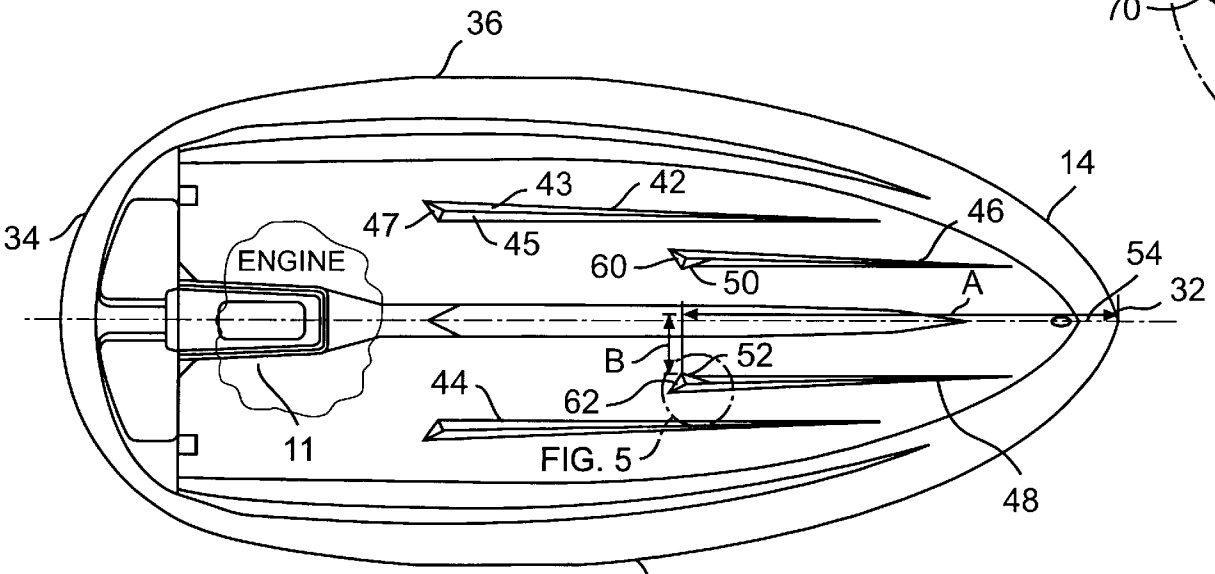
FIG. 4 is a bottom view of the hull of the boat illustrated in FIG. 1.

As depicted in FIG. 4, hull 14 incorporates four chines. The four chines include a port-side outer chine 42, a starboard-side outer chine 44, a port-side inner chine 46, and a starboard-side inner chine 48. Each of the chines 42, 44, 46, and 48 are generally V-shaped in cross-section and extend from a point near bow 32 to a point closer to stern 34 of boat 10. As illustrated, in the preferred embodiment of boat 10, chines 42, 44, 46, and 48 extend longitudinally on hull 14.

Prior to the development of the chine configuration depicted in FIG. 4, all four of the chines 42, 44, 46, and 48 were provided on hull 14 with a construction similar to that for outer chines 42, 44. In other words, as detailed for chine 42, each of the four chines in the prior boat included three triangularly-shaped sections 43, 45, and 47. It was discovered, however, that a boat with such a hull design intermittently experienced porpoising when at higher speeds. It is believed that the porpoising experienced by that boat resulted from an imbalance (or lack of equilibrium) between the center of gravity and the center of buoyancy of the boat when the boat operated at those higher speeds.

Figure 5:
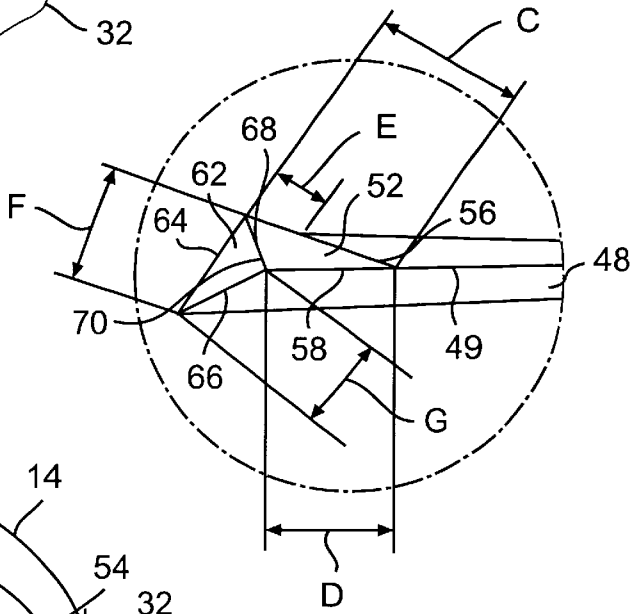
FIG. 5 is a detail of the wedge-shaped modification to the hull of the boat shown in FIG. 1 that is the subject of the present invention.

The inventors realized that if wedge sections 50, 52 were added to the rear of inner chines 46, 48, sporadic porpoising could be eliminated entirely or at least greatly reduced. Wedge sections 50, 52 (an enlarged detail of which is shown in FIG. 5) are believed to eliminate porpoising by readjusting the balance between the center of gravity and the center of buoyancy of boat 10. As discussed above, the beneficial effects of wedge sections 50, 52 are most pronounced when boat 10 is travelling at higher speeds, which is the point where it has been observed that the equilibrium between the center of gravity and the center of buoyancy can be lost. While the exact dynamic is not completely understood, it is believed that wedge sections 50, 52 create a localized turbulence under hull 14 that tends to lift bow 32 of boat 10 higher in the water. It is believed that this increased lift counteracts the negative effects when the center of gravity and the center of buoyancy are not in equilibrium.

The details of wedge sections 50, 52 will now be described in connection with FIGS. 4 and 5.

While wedge section 52 is described in greater detail below, it should be noted that the same construction is provided for wedge section 50 in the preferred embodiment of the present invention. While the construction of wedge section 50 is similar to that of wedge section 52, it is a mirror image of wedge section 52. In other words, wedge sections 50, 52 are symmetrical about centerline 54 of hull 14. Similarly, inner chines 46, 48 and outer chines 42, 44, share a construction that is symmetrical about centerline 54 of hull 14.

As illustrated in FIG. 4, for the preferred embodiment of boat 10, wedge section 52 is disposed longitudinally about 1800 millimeters (mm) (distance A) behind the forward-most point of bow 32. Also, wedge section 52 is disposed laterally about 230 mm (distance B) to the starboard of a centerline 54 of boat 10. Wedge section 52 is triangular in shape and is essentially planar. It has a first edge 56 with a length of about 150 mm (distance C) and a second edge 58 that is about 160 mm long (distance D). The length from the tail end of edge 56 to a position of the apex on edge 56 of wedge section 52, distance E, is about 50 mm. As illustrated, second edge 58 is co-extensive with a central ridge 49 of chine 48.

The preferred embodiment of boat 10 also includes chine end sections 60, 62 positioned at the end of inner chines 46, 48, respectively. Chine end sections 60, 62 are mirror images of one another. As a result, while chine end section 62 will be described in greater detail below, it should be understood that the discussion applies equally to chine end section 60.

Chine end section 62 is essentially planar. It has a first edge 64 that is about 115 mm (distance F) in length and a second edge 66 that is about 100 mm long (distance G). First edge 64 of chine end section 62 defines the rear end of chine 48 on hull 14.

Being triangularly-shaped, wedge section 52 has a third edge 68 with a predetermined length. Similarly, chine end section 62 has a third edge 70, also with a predetermined length. As shown in FIG. 5, third edge 68 of wedge section 52 is co-extensive with third edge 70 of chine end section 62. As a result, third edge 68 and third edge 70 have the same predetermined length.

As would be appreciated by those skilled in the art, wedge sections 50, 52 need not be triangular in shape, nor do they need to be positioned near the rear of inner chines 46, 48. All that is required is that the wedge sections, whatever their shape and placement, eliminate or minimize the potential for porpoising of the boat.

As also would be appreciated by those skilled in the art, the dimensions provided for the preferred embodiment of boat 10 are merely exemplary of the specific embodiment described herein. If boat 10 is made larger or smaller than the embodiment preferred, the dimensions of wedge sections 50, 52 would be adjusted accordingly.

The preferred embodiment of the present invention is meant to be exemplary of the present invention only. As would be understood by those skilled in the art, there are innumerable alternatives to the present invention that satisfy the objects set forth herein. The description of the preferred embodiment of the boat and hull of the present invention is not meant to be limiting in any way to only the embodiment described and claimed.

What is claimed is:

1. A hull, comprising:

bow, stern, port and starboard sides;

at least one chine extending longitudinally from a first point on the hull to a second point closer to the stern than the first point; and at least one wedge section disposed along the at least one chine at an intermediate position between the first and second points on the at least one chine, wherein the at least one wedge is adapted to minimize porpoising of the hull when in operation.

2. The hull of claim 1, wherein:

the at least one chine comprises two chines, one disposed on the port side and the other disposed on the starboard side;

each chine is v-shaped in cross-section;

each chine has an inner side facing a centerline of the hull;

each chine has an outer side facing a side of the hull; and the at least one wedge section comprises two wedge sections.

3. The hull of claim 2, wherein:

the two wedge sections are triangular, are disposed on the inner sides of the chines, and face inwardly toward the centerline of the hull.

4. The hull of claim 3, further comprising:

chine end sections disposed at the second point of each chine, forming a triangular end to each chine, wherein the wedge sections are disposed adjacent to the chine end sections.

5. The hull of claim 4, wherein the wedge sections and chine end sections share a common edge.

6. The hull of claim 5, wherein the wedge sections are disposed longitudinally about 1800 mm from a forward-most portion of the bow.

7. The hull of claim 6, wherein the wedge sections are disposed laterally about 230 mm from the centerline of the hull.

8. The hull of claim 7, wherein the wedge sections have a length of 150 mm along a first edge, 160 mm along a second edge, and a predetermined length along a third edge.

9. The hull of claim 8, wherein the chine end sections are triangular in shape with a length of 115 mm along a first edge, 100 mm along a second edge, and, along a third edge, equal in length to the third edge of the wedge sections.

10. A boat, comprising:

a deck;

a powered hull connected to the deck, the hull having bow, stern, port and starboard sides;

at least one chine extending longitudinally from a first point on the hull to a second point closer to the stern than the first point; and at least one wedge section disposed along the at least one chine at an intermediate position between the first and second points on the at least one chine, wherein the at least one wedge is adapted to minimize porpoising of the hull when in operation.

11. The boat of claim 10, wherein:

the at least one chine comprises two chines, one disposed on the port side and the other disposed on the starboard side;

each chine is v-shaped in cross-section;

each chine has an inner side facing a centerline of the hull;

each chine has an outer side facing a side of the hull; and the at least one wedge section comprises two wedge sections.

12. The boat of claim 11, wherein:

the two wedge sections are triangular, are disposed on the inner sides of the chines, and face inwardly toward the centerline of the hull.

13. The boat of claim 12, further comprising:

chine end sections disposed at the second point of each chine, forming a triangular end to each chine, wherein the wedge sections are disposed adjacent to the chine end sections.

14. The boat of claim 13, wherein the wedge sections and chine end sections share a common edge.

15. The boat of claim 14, wherein the wedge sections are disposed longitudinally about 1800 mm from a forward-most portion of the bow.

16. The boat of claim 15, wherein the wedge sections are disposed laterally about 230 mm from the centerline of the hull.

17. The boat of claim 16, wherein the wedge sections have a length of 150 mm along a first edge, 160 mm along a second edge, and a predetermined length along a third edge.

18. The boat of claim 17, wherein the chine end sections are triangular in shape with a length of 115 mm along a first edge, 100 mm along a second edge, and, along a third edge, equal in length to the third edge of the wedge sections.

19. The hull of claim 1, wherein the second point is disposed forward of the stern.

20. The boat of claim 10, wherein the second point is disposed forward of the stern.

21. A hull, comprising:

bow, stern, port and starboard sides;

a running surface defined by an underside of hull;

at least one chine protruding downwardly from the running surface, the at least one chine extending longitudinally from a first point on the hull to a second point closer to the stern than the first point; and at least one wedge section protruding laterally from the at least one chine.

22. The hull of claim 21, wherein the at least one wedge section protrudes downwardly from the running surface.

23. A boat, comprising:

a deck;

a power hull connected to the deck, the hull having bow, stern, port and starboard sides;

a running surface defined by an underside of hull;

at least one chine protruding downwardly from the running surface, the at least one chine extending longitudinally from a first point on the hull to a second point closer to the stern than the first point; and at least one wedge section protruding laterally from the at least one chine.

24. The hull of claim 23, wherein the at least one wedge section protrudes downwardly from the running surface.

* * * * *